United States Patent [19]

Balas, Jr.

[11] 4,381,648

[45] May 3, 1983

[54] STIRLING CYCLE APPARATUS WITH METAL BELLOWS SEAL

[75] Inventor: Charles Balas, Jr., Denville, N.J.

[73] Assignee: North American Philips Corporation, New York, N.Y.

[21] Appl. No.: 220,948

[22] Filed: Dec. 29, 1980

[51] Int. Cl.[3] ..... F02G 1/04

[52] U.S. Cl. ..... 60/517

[58] Field of Search ..... 60/517, 521, 522, 525, 60/526

[56] References Cited

U.S. PATENT DOCUMENTS 3,568,436 3/1971 Heffner et al. ..... 60/517

3,667,348 6/1972 Neelen ..... 60/517 X 3,667,349 6/1972 Siebert et al. ..... 60/517 X

*Primary Examiner*—Allen M. Ostrager

*Attorney, Agent, or Firm*—David R. Treacy

[57] ABSTRACT

A Stirling cycle engine or refrigerator with a reciprocating piston within a cylinder and a reciprocating displacer rod within the bore of the piston, has a first generally cylindrical metal bellows sealing the space between the cylinder and piston and a second metal bellows sealing the space between the piston and displacer rod. A constant volume of substantially incompressible liquid is maintained in spaces adjacent and supporting one side of each bellows with the opposite sides respectively exposed to working gas at operating pressures of the apparatus.

12 Claims, 2 Drawing Figures

Figure 1:
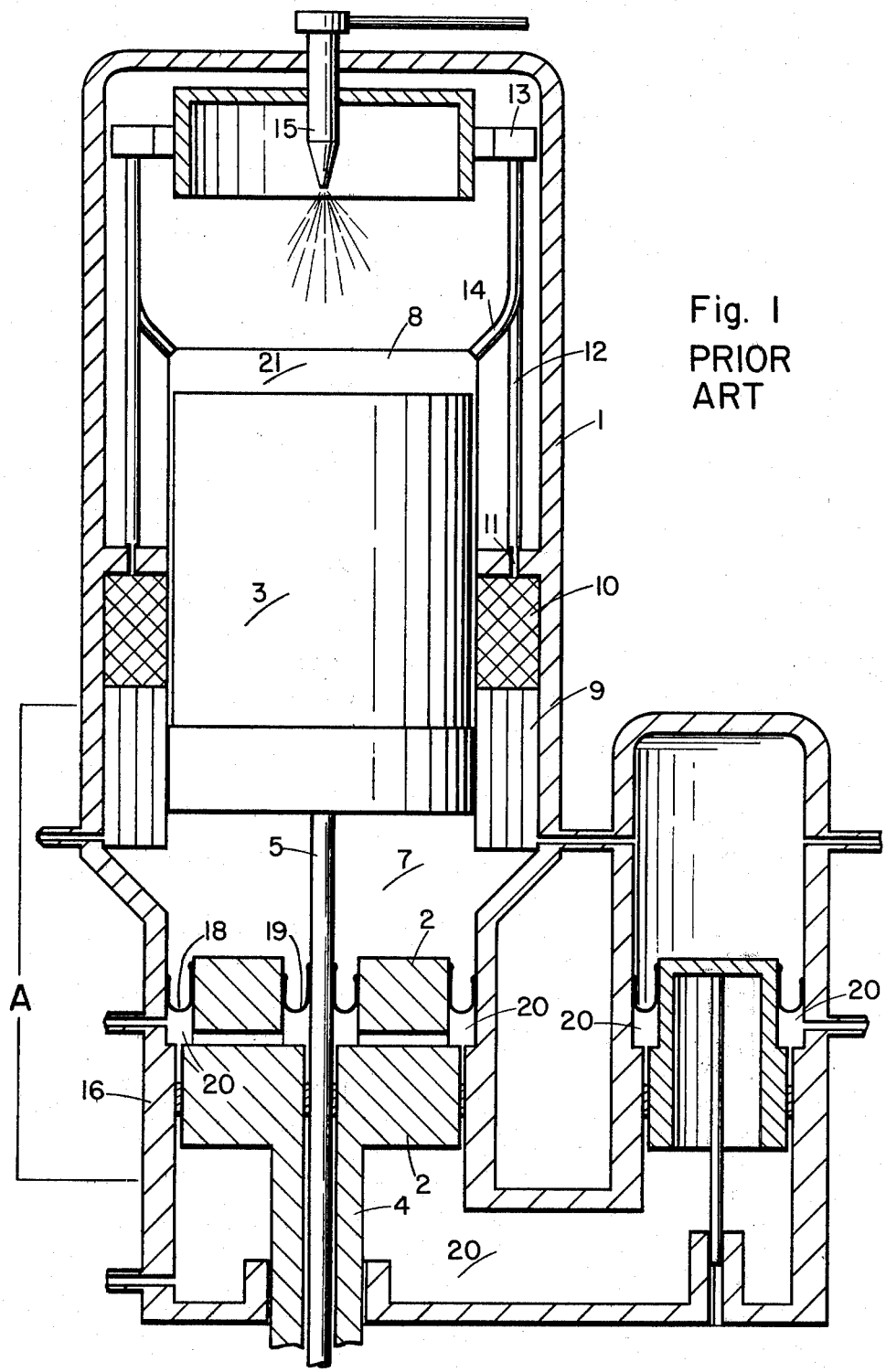

PRIOR
ART

STIRLING CYCLE APPARATUS WITH METAL BELLOWS SEAL

BACKGROUND OF THE INVENTION

This invention is in the field of Stirling cycle engines and refrigerators, particularly the type where a reciprocating piston in a cylinder has a central bore through which extends a reciprocating displacer rod. Traditionally in these machines rubber rollsock or rolling diaphragm seals are used between the displacer rod and the bore of the piston, and between the bore of the cylinder and the outer surface of the piston. Since the piston and displacer reciprocate at the same rate but in an out-of-phase relationship, the axial distance between them constantly varies, and seals between the piston and displacer rod and cylinder respectively must be capable of cyclic extension and compression while remaining securely attached to corresponding surfaces.

The typical rollsock seal is an elongated rubber sleeve with one end rolled back toward the other end so that the overlying portions define a generally U-shape in a cross-sectional view, which is the area that cyclicly bends and reverse bends. To prevent the rollsock from stretching excessively during normal operation of the apparatus a quantity of substantially incompressible liquid such as oil lubricant from below the piston is maintained on the lower side of the rollsock opposite the side exposed to high pressure working gas. As long as the working gas pressure is greater than the liquid pressure, the rollsock will be urged toward the incompressible liquid. The liquid below the sock supports and prevents the sock from stretching excessively, and the pressure toward the liquid prevents the sock from forming folds or pleats in the direction away from the liquid.

With these rubber or equivalent composition rollsock seals a persistant problem is diffusion of the typical helium or hydrogen working gas through the rubber membrane into the supporting liquid. Such gas lost by diffusion must be removed from the liquid or the latter will cease to be incompressible. This gas diffusion problem is actually twofold, because the working gas lost by diffusion must be replaced by using the recovered gas or by other new gas. When the Stirling cycle device is an engine as contrasted to a refrigerator, the high operating temperatures contribute to deterioration of the rubber seals in addition to the diffusion problem.

Metal has been considered as an alternative to the rubber material of the rollsocks, because the metal is impervious to gas diffusion and the metal will not deteriorate at the elevated temperatures applicable hereto. Nevertheless, metal rollsocks are not feasible, because very thin metal, if configured as a rollsock, would rupture either from the pressure applied or from the reverse bending about small radii, and metal thick enough to avoid rupture would be too stiff. Practically any metal seal selected will introduce spring forces into the dynamic system which must be overcome or be considered in overall force and torque balancing and in overall efficiency.

Metal bellows have been used in various situation, primarily as flexible conduits which are thin and flexible where pressure is negligible and/or substantial movement is required, or are thick and stiff where pressure is great and/or movement is negligible or slow as in valves.

None of these known rollsock or bellows elements as known will solve the Stirling cycle engine and refrigerator problems discussed above. The present invention, however, involves metal bellows that may be very thin foil and that will operate successfully in Stirling engines or refrigerators with the advantage of rollsocks and the exlusion of the persistent problems.

SUMMARY OF THE INVENTION

The invention is a Stirling cycle device using at least one and preferably two metal bellows seals with their opposite ends secured respectively between the piston and cylinder and between the piston and displacer rod. Space or volume defined by or between these two bellows is filled with substantially incompressible liquid, and such volume is kept essentially constant even though both the piston and the displacer rod are moving relative to each other. Such constant volume is achieved for example, by selecting the diameter of the displacer rod and the diameter of the lower part of the piston through which this rod extends and which defines a boundary of the incompressible liquid volume, so that any volume changes due to piston or bellows motion are compensated for. The pressure of this liquid can be maintained less than or substantially the same as the mean pressure of the gas in the buffer volume on the opposite sides of these bellows by use of a pressure regulator or other means.

This invention eliminates not only the gas diffusion and high temperatures deterioration problems, but also eliminates the limitations on structure and design on the piston, cylinder, and displacer rod, previously established by the rollsock design. The new construction is light in weight and is relatively easily incorporated into the overall construction.

Preferred embodiments of this bellows seal apparatus are illustrated in the drawings appended hereto with further description as follows:

DESCRIPTION OF THE DRAWINGS AND PREFERRED EMBODIMENTS

Figure 2:
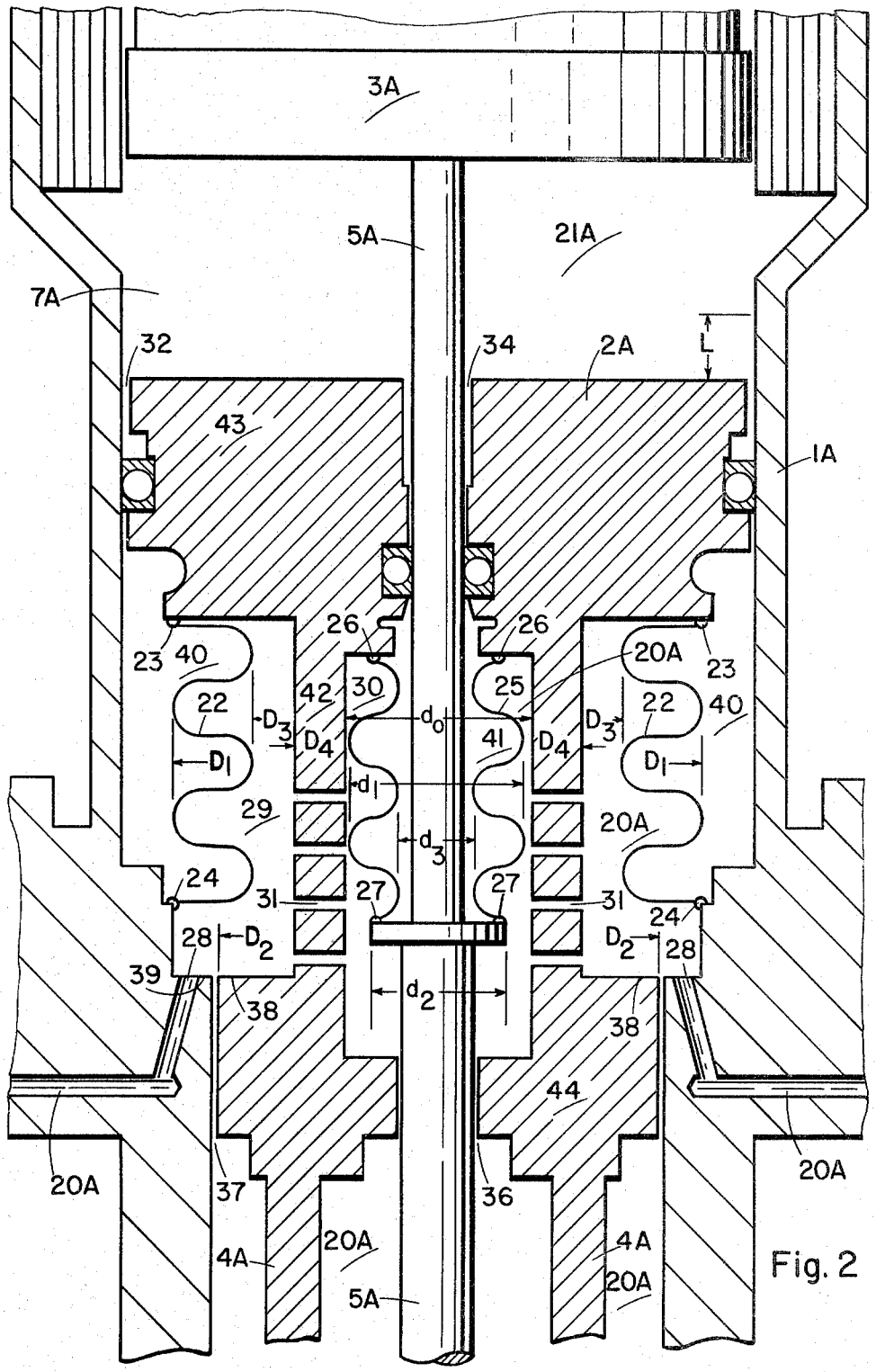

FIG. 1 is a schematic view in section of a prior art Stirling cycle engine; and FIG. 2 is a fragmentary sectional view of a Stirling apparatus including the new bellows seal, corresponding to the area marked A in FIG. 1.

FIG. 1 illustrates typical features of a prior art Stirling engine. Since the basic features and operating principals of Stirling engines and refrigerators are well known, the only elements that will be referred to in FIG. 1 will be those most relevant to the subject invention. Within the cylinder 1, piston 2 and displacer 3 reciprocate via piston rod 4 and displacer rod 5 respectively. A drive mechanism not shown drives the piston and displacer in the correct out-of-phase relationship. Between the piston and displacer is variable-volume compression space 7, and above the displacer is variable-volume expansion space 8. Connecting these two spaces are the cooler 9, regenerator 10, the heater and associated parts 11–14, and the burner 15. Between piston 2 and displacer rod 5 is rollsock or rolling diaphragm seal 19, and between piston 2 and the crankcase 16 is similar rollsock seal 18. Beneath both rollsocks and optionally beneath piston 2 is incompressible liquid 20. In spaces 7 and 8 and above the rollsock seals is a working gas 21, such as hydrogen or helium. The focus of the present invention is on seals 18, 19 and the surfaces of the piston, displacer rod, and crankcase to which these seals are attached and which define critical volumes.

In FIG. 2 the components corresponding to those in FIG. 1 will be given the same reference numbers, but with a suffix A added. Accordingly in FIG. 2, in cylinder 1A, piston 2A and displacer 3A are reciprocated via their rods 4A and 5A respectively. An outer bellows 22 having an outer diameter $D_1$ and an inner diameter $D_3$ is attached at its upper end 23 to the piston 2A and at its lower end 24 to the crankcase or cylinder 1A. An inner bellows 25 having an outer diameter $d_1$ and an inner diameter $d_3$ is attached at its upper end 26 to the piston and at its lower end 27 to the displacer rod 5A. Working gas 21A is shown between piston 2A and displacer 3A and in annular space 40 adjacent the outside surface of outer bellows 22 and in annular space 41 adjacent the inside surface of the inner bellows 25, as will be further explained later. Incompressible liquid 20A is shown adjacent the inner surface of bellows 22 and adjacent the outer surface of bellows 25 and generally beneath a portion of piston 2A. This liquid 20A supporting the two bellows enters duct 28 to annular space 29 inward of bellows 22 and to annular space 30 outward of bellows 25, spaces 29 and 30 being in communication via radial passages 31 through a lower wall or skirt 42 of piston 2A.

Because of these bellows seals any working gas in compression space 7A that leaked past annular slit 32 into annular space 40 could not escape the lower end of bellows 22 fixed to the crankcase. Similarly, any working gas that leaked past the annular slit 34 into annular space 41 between the displacer rod 5A and the piston lower wall could not escape past the lower end 27 of the bellows 25 fixed to the displacer. Similarly, liquid cannot move past either of the bellows because of their hermetically sealed ends 23, 24 26 and 27 respectively.

In the illustration of FIG. 2 the fixed reference would be the cylinder 1A relative to which piston 2A reciprocates an axial stroke L; this is the same stroke or extension experienced by outer bellows 22, specifically when the piston rod's stepped shoulder 38 moves relative to the cylinder's adjacent abutment 39. The liquid space 29 inward of bellows 22 corresponds to an annular cylinder of liquid having an outer diameter $D_1$ and an inner diameter $D_4$ corresponding to the outer diameter of the cylindrical wall part 42 of the piston radially inward of the bellows 22; the stepped shoulder 38 has an intermediate diameter $D_2$, between those two values. By proper selection of $D_1$, $D_2$, $D_3$, and $D_4$, the volume of liquid in space 29 will remain essentially constant during stroke L of the piston. The fact that a moving liquid volume between a piston and a cylinder can be maintained constant under a rollsock seal in a Stirling engine or refrigerator has been disclosed in numerous prior art publications, examples of which are listed in the appendix I attached hereto. The present invention utilizes a set of two metal bellows of configuration totally different from rollsocks. The inner bellows 25 defines a volume of liquid of outer diameter $d_0$ corresponding to the inner diameter of the wall part 42, and inner diameter $d_3$, with a displacer rod stepped shoulder intermediate diameter $d_2$, corresponding respectively to diameters $D_4$, $D_2$ and $D_3$ for bellows 22.

As with bellows 22 and space 29 the volume of liquid in space 30 partially contained by bellows 25 can be kept constant during relative motion of displacer rod 5A and the rigid body composed of piston 2A and piston rod 4A. This is accomplished by proper selection of $d_1$, $d_2$ and $d_3$. Therefore, volumes 29, 30 and 31 will remain constant for any reciprocating motion of piston—piston rod and displacer—displacer rod.

The mean oil pressure in spaces 29, 30 and 31 is maintained by a pressure regulator not shown, such pressure being generally less than the mean working gas pressure experienced by the outer surface of bellows 22 in space 40 and the inner surface of bellows 25 in space 41, this approximately corresponding to the mean value of the pressure of the working gas 21A in compression space 7A. The pressure regulator also serves to replace any oil that leaks out of space 29, 30, 31—such leakage usually occurring through narrow annular slits 36 and 37. The amount of such leakage through these slits during any one cycle of engine operation is typically negligible in its effect on bellows deflection.

In Stirling engines the temperature of working gas in compression space 7A, while substantially less than the temperature in the expansion space above the displacer, is still sufficiently high to elevate the temperature of the piston and the seal below the piston. The advantage of using the new metal bellows seals which are essentially not damaged by these elevated temperatures is obvious. The great flexibility in structural shape and size of the new seals is also highly advantageous. In the embodiment shown these bellows are situated totally below the main part of the piston, as opposed to being in the space between adjacent side walls of the piston and cylinder. This allows for good bearing engagement of the piston and cylinder without the interference of a rollsock attachment in the vicinity of the bearing surface, and without the possibility of wear due to contact of the seal against a wall of the piston or cylinder, as usually occurs with the rollsock seals. As shown the new bellows seals extend parallel to the central axis of the piston with the top and bottom ends 23 and 24 respectively of bellows 22 for example in direct alignment; however variations in alignment are obviously possible.

In the embodiment illustrated in FIG. 2 annular spaces 29 and 30 for the incompressible liquid may be defined in part by recesses in the piston wall that extend both radially and axially. The piston thus has an upper, main or head part 43, and a cylindrical wall part 42 which is perforated by radially-extending passages 31 and is connected to a bottom part 44 which is formed either as a piston bottom part having a diameter greater than the cylindrical wall part, or as an extension of the piston rod 4A or equivalent drive element.

An exemplary Stirling cycle machine proposed according to the invention would use two metal bellows each made of a metal foil having a thickness no greater than 0.005 inches (125 microns). The outer bellows has an outer diameter $D_1$ of $\frac{1}{2}$ inch (12.7 mm), and the piston has a stepped shoulder diameter $D_2$ of $\frac{3}{8}$ inch and a cylindrical wall part diameter of $\frac{1}{4}$ inch (9.7 and 6.3 mm respectively); while the cylindrical wall part has an inner diameter of 5/32 inch (4 mm), the inner bellows has an outer diameter of $\frac{1}{8}$ inch (3.2 mm) and the displacer rod stepped shoulder intermediate diameter $d_2$ is 3/64 inches (1.2 mm).

Many variations of this structural arrangement are possible within the scope of this invention which is intended to include both Stirling and other thermodynamic cycle apparatus. The bellows may have configurations other than straight cylinders parallel to the piston axis. Also the Stirling engine or refrigerator in combination with the new bellows seals may have multiple aligned or non-aligned piston-displacer-cylinders. Within the above possibilities the bellows seals may be concentric but axially displaced from each other. Furthermore the supporting liquid may be contacting the inner side of each of two concentric bellows, with the working gas contacting the outer side of these bellows respectively. For this latter arrangement the piston may be double-walled with the outer wall between the two bellows, and the inner wall between the inner bellows and a central displacer rod extending through the central bore of the piston.

The above-described apparatus are merely preferred embodiments of the subject invention, with equivalent variations possible within the scope and spirit of the invention as defined in the appended claims.

What is claimed is:

1. In a thermodynamic cycle apparatus including a cylinder having a bore and cylinder walls; a piston and an other element axially spaced apart and reciprocated within said bore; a hollow piston rod fixed to and extending downward from said piston and an other element rod fixed to and extending downward from said other element, through said piston and through the bore of said hollow piston rod for relative axial reciprocation; said cylinder and said piston defining a variable volume compression space for containing a working gas, and a space below said piston in said cylinder bore and including said piston and other element rods, the improvement wherein a portion of the cylinder wall and said piston rod define an outer annular space therebetween, and the hollow piston rod inner wall and said other element rod define an inner annular space therebetween, and said apparatus further comprises a metal outer bellows and a metal inner bellows, each having a generally cylindrical shape with opposite top and bottom ends, said outer bellows being secured in said outer annular space, with its top end fixed and hermetically sealed to said piston and its bottom end similarly fixed to said cylinder, arranged so as to define and separate an outer liquid space and an outer gas space; said inner bellows being secured in said inner annular space, with its top end fixed and hermetically sealed to said piston, and its bottom end similarly fixed to said other element rod, arranged so as to define and separate an inner liquid space and an inner gas space, means for filling said inner and outer liquid spaces with a substantially incompressible liquid, means for maintaining the volume of each of said inner and outer liquid spaces, and the liquid therein, substantially constant, and means for maintaining working gas in said inner and outer annular gas spaces at a pressure greater than that of said liquid in said liquid spaces, whereby said working gas is prevented from flowing from said compression space past said piston to said inner or outer liquid spaces.

2. An apparatus according to claim 1, wherein said piston includes a hollow cylindrical wall part extending from a main part of the piston toward the piston rod; said outer liquid space is arranged between said outer bellows and said cylindrical wall part, and said outer gas space is arranged between said outer bellows and a wall of the cylinder bore; and said inner liquid space is arranged between said inner bellows and said cylindrical wall part, and said inner gas space is arranged between said inner bellows and said other element rod.

3. An apparatus as claimed in claim 2, wherein said cylindrical wall part includes conduits therethrough communicating between said inner and outer liquid spaces.

4. An apparatus as claimed in claim 3, wherein said inner and outer bellows are disposed concentrically and generally in the same axial location with respect to said piston.

5. An apparatus as claimed in claim 2, wherein said means for maintaining constant volume comprises an arrangement of said outer bellows and said piston and piston rod such that said outer bellows has an outer diameter $D_1$; a part of said piston rod interiorly adjacent said outer bellows has a diameter $D_4$; a part of said piston or a piston rod extension below said bellows, closely fitting in said cylinder bore, has a diameter $D_2$; and $D_1 > D_2 > D_4$.

6. An apparatus as claimed in claim 5, wherein said means for maintaining the volume of said inner liquid space constant comprises an arrangement of said inner bellows, piston part or piston rod extension, and said other element rod, such that the inner bellows has an outside diameter $d_1$ and inside diameter $d_3$, said cylindrical wall part adjacent the exterior of said inner bellows has an inner diameter $d_0$, and said other element rod below said inner bellows has a diameter $d_2$, said diameters satisfying the ratio $d_0 > d_1 > d_2 > d_3$.

7. An apparatus as claimed in claim 2, wherein each of said bellows has a generally straight cylindrical shape whose cross section has continuous smooth curved reverse bends.

8. An apparatus as claimed in claim 7, wherein said apparatus is a Stirling cycle apparatus, and said other element is a displacer.

9. An apparatus as claimed in claim 6, wherein each of said bellows is formed from a metal foil having a thickness no greater than 0.005 inches.

10. An apparatus as claimed in claim 2, wherein said cylindrical wall part has a circular cylindrical shape having outside diameter less than that of said piston main part, and said cylindrical wall part is connected to a piston part or piston rod extension closely fitted in the cylinder bore and having a diameter greater than said cylindrical wall part.

11. An apparatus as claimed in claim 1, wherein the attachments of the ends of said bellows to said piston, cylinder and other element rod respectively comprise welding, brazing or the equivalent to provide hermetic seals.

12. An apparatus as claimed in claim 1 wherein said piston comprises (a) a top head part having an outer diameter in a sliding fit within said bore of said cylinder, and a bore in a sliding fit with said other element rod, and (b) an intermediate part extending downward from said head part, and having an outer diameter radially spaced from said cylinder bore to define said outer annular space, and a bore radially spaced from said other element rod to define said inner annular space; and a piston rod extension or a bottom part of said piston has an outer diameter in a sliding fit with said cylinder bore but less than the outer diameter of said head part and greater than the outer diameter of said intermediate part, and has its bore in a sliding fit with said other element rod.

* * * * *